US006168348B1

(12) United States Patent
Meyer et al.

(10) Patent No.: US 6,168,348 B1
(45) Date of Patent: Jan. 2, 2001

(54) BI-DIRECTIONAL SURFACE LEVELING SYSTEM

(75) Inventors: Frederick A. Meyer, Lutz; Robert W. Crowley, Land O'Lakes; Dana E. Schroeder, Spring Hill, all of FL (US)

(73) Assignee: Southern Laser, Inc., Lutz, FL (US)

( * ) Notice: Under 35 U.S.C. 154(b), the term of this patent shall be extended for 0 days.

(21) Appl. No.: 09/008,226

(22) Filed: Jan. 16, 1998

(51) Int. Cl.[7] ..... E01C 23/08; E02F 3/76

(52) U.S. Cl. ..... 404/90; 404/84.1; 37/117.5

(58) Field of Search ..... 404/84.1, 90, 118; 172/437, 449, 799.5, 439; 342/357; 37/117.5

(56) References Cited

U.S. PATENT DOCUMENTS

| | | | | |
|---|---|---|---|---|
| 1,885,804 | * | 11/1932 | Cundiff | 172/439 |
| 2,724,314 | * | 11/1955 | Evans . | |
| 2,818,664 | * | 1/1958 | Bond | 172/439 |
| 3,554,291 | | 1/1971 | Rogers et al. . | |
| 3,604,512 | | 9/1971 | Carter et al. . | |
| 3,659,949 | | 5/1972 | Walsh et al. . | |
| 3,953,145 | * | 4/1976 | Teach | 404/84 |
| 4,019,585 | | 4/1977 | Dezelan . | |
| 4,073,346 | * | 2/1978 | Groth et al. | 172/439 |
| 4,162,708 | | 7/1979 | Johnson . | |
| 4,378,052 | * | 3/1983 | Anderson | 172/449 |
| 4,393,608 | | 7/1983 | Hodge . | |
| 4,490,929 | | 1/1985 | Lucas . | |
| 4,537,259 | | 8/1985 | Funabashi et al. . | |
| 4,677,555 | | 6/1987 | Goyet . | |
| 4,807,131 | | 2/1989 | Clegg . | |
| 4,871,025 | | 10/1989 | Mayfield et al. . | |
| 4,895,440 | | 1/1990 | Cain et al. . | |
| 4,918,608 | | 4/1990 | Middleton et al. . | |
| 4,978,246 | * | 12/1990 | Quenzi et al. | 404/84 |
| 5,107,932 | | 4/1992 | Zachman et al. . | |
| 5,108,229 | | 4/1992 | Slanker . | |
| 5,172,499 | * | 12/1992 | Griffin | 37/117.5 |
| 5,174,385 | | 12/1992 | Shinbo et al. . | |
| 5,184,293 | | 2/1993 | Middleton et al. . | |
| 5,327,345 | | 7/1994 | Nielson et al. . | |
| 5,330,287 | * | 7/1994 | Constantin | 404/90 |
| 5,397,200 | * | 3/1995 | Seal | 404/118 |
| 5,427,185 | * | 6/1995 | Seal | 404/118 |
| 5,436,768 | | 7/1995 | Ammann . | |
| 5,511,326 | | 4/1996 | Liebrecht, Jr. . | |
| 5,631,658 | * | 5/1997 | Gudat et al. | 342/357 |
| 5,671,554 | | 9/1997 | Geelhoed . | |

OTHER PUBLICATIONS

New Holland Web Page "In your sites" pp. 1–3, Sep. 27, 1999.*

Land Pride Web Page "We've got you covered" pp. 70–72, 74,75, Sep. 27, 1999.*

* cited by examiner

*Primary Examiner*—Eileen D. Lillis
*Assistant Examiner*—Raymond Addie
(74) *Attorney, Agent, or Firm*—Akerman, Senterfitt & Eidson, P.A.

(57) ABSTRACT

A bi-directional surface leveling system comprises a chassis attachable to a motion source and having a hitch, a grader frame pivotably connected to the hitch and supporting a box grader, and a forward frame pivotably attached to the grader frame and having a caster wheel for supporting the chassis. The box grader holds a bi-directional earth grading tool. Also included is a damping assembly attached to the hitch to dampen upward movement of the grader frame. A powered assembly is pivotably connected at one end to the forward frame and at the opposing end to the grader frame, and a control unit connected to the power assembly selectively extends and retracts the power assembly.

5 Claims, 4 Drawing Sheets

BI-DIRECTIONAL SURFACE LEVELING SYSTEM

CROSS REFERENCE TO RELATED APPLICATIONS (Not Applicable)

STATEMENT REGARDING FEDERALLY SPONSORED RESEARCH OR DEVELOPMENT (Not Applicable)

FIELD OF THE INVENTION

This invention relates to earth moving equipment and more particularly to a new and improved surface leveling system capable of leveling earth in two directions.

BACKGROUND OF THE INVENTION

Leveling systems such as scrapers or graders are commonly used for roughly leveling relatively large areas of ground and are well known in the art. These leveling systems are commonly pushed or pulled by bulldozers, tractors, or other similar equipment. These leveling systems have also been known to be self-propelled. The wide variety of available motive sources are able to move the leveling systems in many different directions. However, current leveling systems are not capable of using this ability.

Current leveling systems are able to effectively grade earth in, for example, a forward direction, but not in a reverse direction. One common reason why these systems are not used in two directions is that the hitches used for connecting the earth-grading tool to the motive source have generally been designed for use in only one direction. An example of a hitch well known in the art that only works well in one direction is a three point hitch. Although a three point hitch works well pulling an earth grading tool, the hitch does not work well pushing the tool because the force of the earth on the tool tends to push the tool upwards.

As a result of the directional limitation of current leveling systems, these systems must execute complex maneuvering to properly level the ground. An analogy to the difficulties with current leveling systems is to imagine driving into and out of a driveway with a car that does not have reverse. The maneuver is simple when the car can travel in two directions. However, the maneuver is very complex when effective travel is limited to only one direction. Additionally, as is well known in the art, leveling systems must sometimes grade surfaces several times before the surfaces are level. Without having the ability to effectively grade earth in both directions, current leveling systems must completely turn around before a surface can be regraded. This excess maneuvering wastes motion, and therefore, wastes time.

Laser beam level control systems are commonly used with leveling systems to define a precise reference level. With such systems, a laser beam reference level is used to enable the leveling systems to create a uniformly level surface that cannot be easily achieved using conventional level control systems. The effectiveness of the laser beam level control systems are also limited by leveling systems that can only grade earth in one direction.

SUMMARY OF THE INVENTION

It is an object of this invention to provide an earth leveling system capable of being pushed or towed by a motion source.

It is another object of this invention to provide an earth leveling system that levels earth in at least two directions.

It is yet another object of this invention to provide an earth leveling system having a multi-link hitch that can be pushed.

It is still another object of this invention to provide an earth leveling system that combines the advantages of a laser beam level control system with bi-directional leveling.

In accordance with the invention, these and other objects are accomplished by providing a earth leveling system comprising a chassis having a hitch, a grader frame, and a forward frame having a caster wheel to support the chassis. The hitch comprises a rear support having means for attachment to a motive unit and a plurality of mechanical links substantially parallel to one another. One end of the links are pivotably attached to the rear support and the opposing end to a middle support fixedly connected to the box grader frame. The grader frame supports a box grader having a bi-directional earth grading tool. The grader frame is also pivotably attached to the forward frame. Extending above the grader frame is a torque member fixedly attached to the grader frame.

Also included is a damping assembly having upper and lower distal ends and disposed between the rear and middle supports. The upper distal end is pivotably connected to an upper link adjacent the middle support, and the lower distal end is pivotably connected to a lower bar on the rear support.

A hydraulic piston is pivotably connected to the forward frame and to the torque member whereby extending the hydraulic piston raises the grader frame and the earth grading tool relative to ground. A control unit attached to the chassis and hydraulically connected to the hydraulic piston controls the extension and retraction of the hydraulic piston.

In an alternative embodiment of the invention, the surface leveling system further includes a laser beam generator remote from the chassis capable of projecting a laser beam parallel to ground at a predetermined distance above ground. Also included is a laser sensor attached to the chassis and fixedly positioned relative to the earth grading tool for receiving the laser beam. The laser sensor transmits position data to the control unit.

In another alternative embodiment of the invention, the hitch is a three point hitch, and thus, has two lower links and one upper link.

In still another alternative embodiment of the invention, the damping assembly is a shock absorber. The shock absorber preferably also acts as a biasing means for urging the grader frame downward.

BRIEF DESCRIPTION OF THE DRAWINGS

There are shown in the drawings embodiments of the invention that are presently preferred, it being understood, however, that the invention is not limited to the precise arrangements and instrumentalities shown, wherein.

DETAILED DESCRIPTION OF THE PREFERRED EMBODIMENTS

Figure 1:
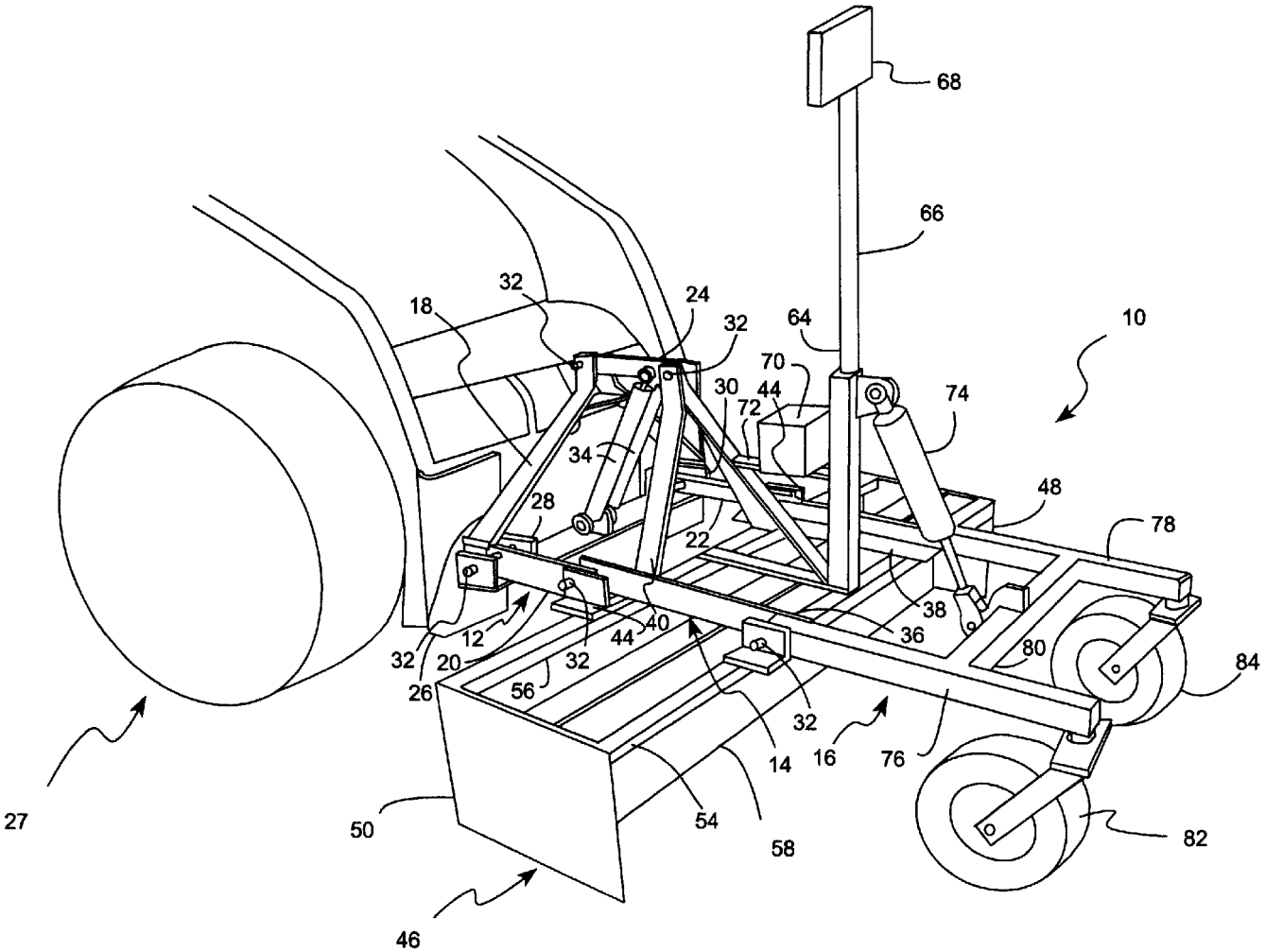
FIG. 1 is a perspective view of a surface leveling system according to the invention and a partial perspective view of a motion source.
Figure 2:
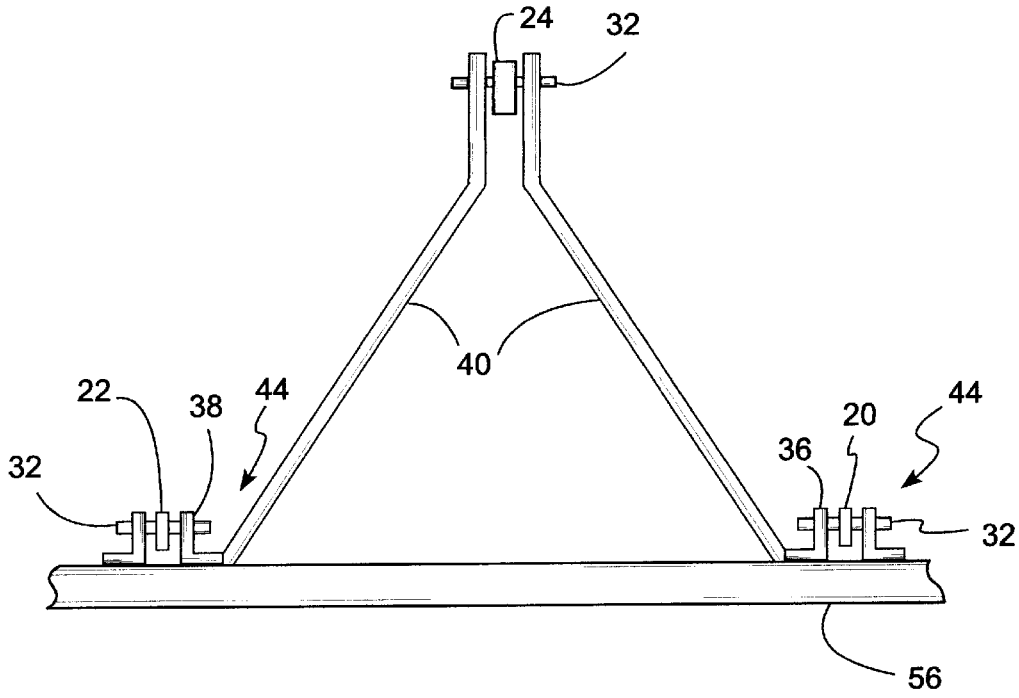
FIG. 2 is a cross section, partially in section, of a hitch.
Figure 3:
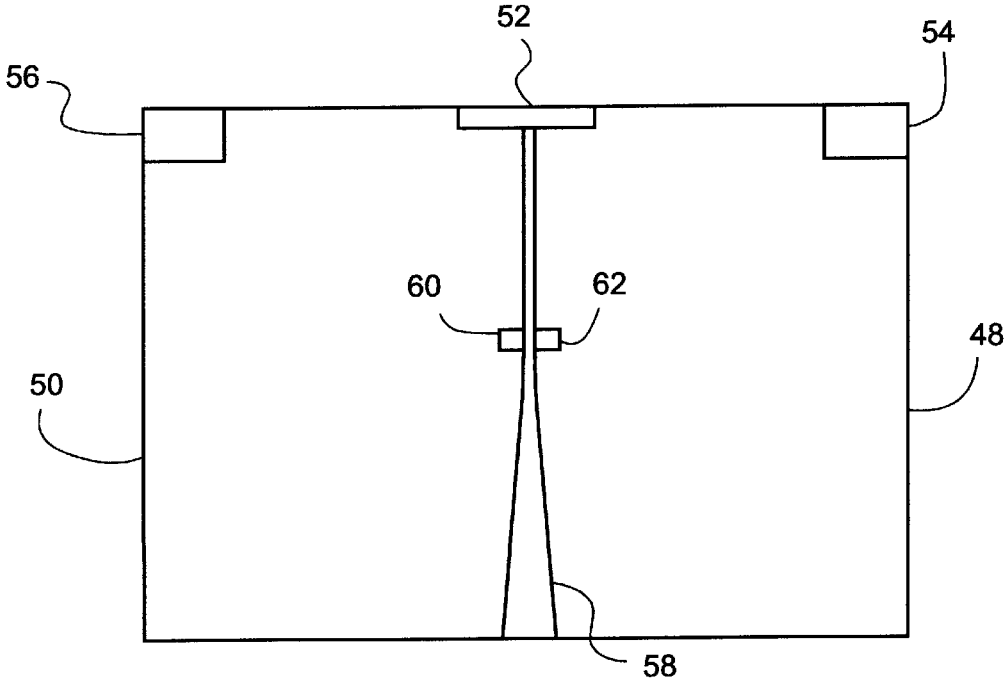
FIG. 3 is a cross section along the lateral axis of a box grader.

FIGS. 1, 2 and 3 illustrate a surface leveling system according to the invention. The surface leveling system's chassis 10 comprises a hitch 12, a box grader frame 14, and a forward frame 16. The box grader frame 14 is pivotably attached to both the hitch 12 and the forward frame 16.

The chassis 10 is connected to a motion source 27 which moves the chassis 10 during the operation of surface leveling. The motion source 27 preferably can push and pull the chassis and can turn in any direction. The motion source 27 preferably has sufficient power to push or pull the weight of the chassis 10 through soft earth, mud, sand or any other medium which is to be leveled. Motion sources 27 capable of such performance are well known in the art of earth moving.

Any variation in the hitch structure is acceptable provided the hitch 12 laterally supports the chassis 10 and allows the box grader frame 14 to translate vertically. In the presently preferred embodiment, the hitch 12 is a three-point hitch. An example of an acceptable alternative hitch well known in the art is a four-point hitch.

The presently preferred hitch 12 comprises several subelements including a rear support 18, lower links 20 and 22, an upper link 24, rear pivot brackets 28 and 30, and an attachment face 26. The attachment face 26 is connected to the rear support 18 and is used to attach the hitch 12 to the motion source 27. Many different means of attaching an attachment face 26 to a motion source 27 are well known in the art of earth moving and any of those attachment means can be used with this invention.

Links 20, 22, and 24 of the hitch 12 can pivot relative to the rear support 18 because the links 20, 22, and 24 are pivotably attached to the rear support 18 and the rear pivot brackets 28 and 30. The upper link 24 is pivotably connected to the upper portion of the rear support 18 with a pivot pin 32, and each of the lower links 20 and 22 are pivotably connected to the rear pivot brackets 28 and 30 also by using pivots pins 32.

Figure 4:
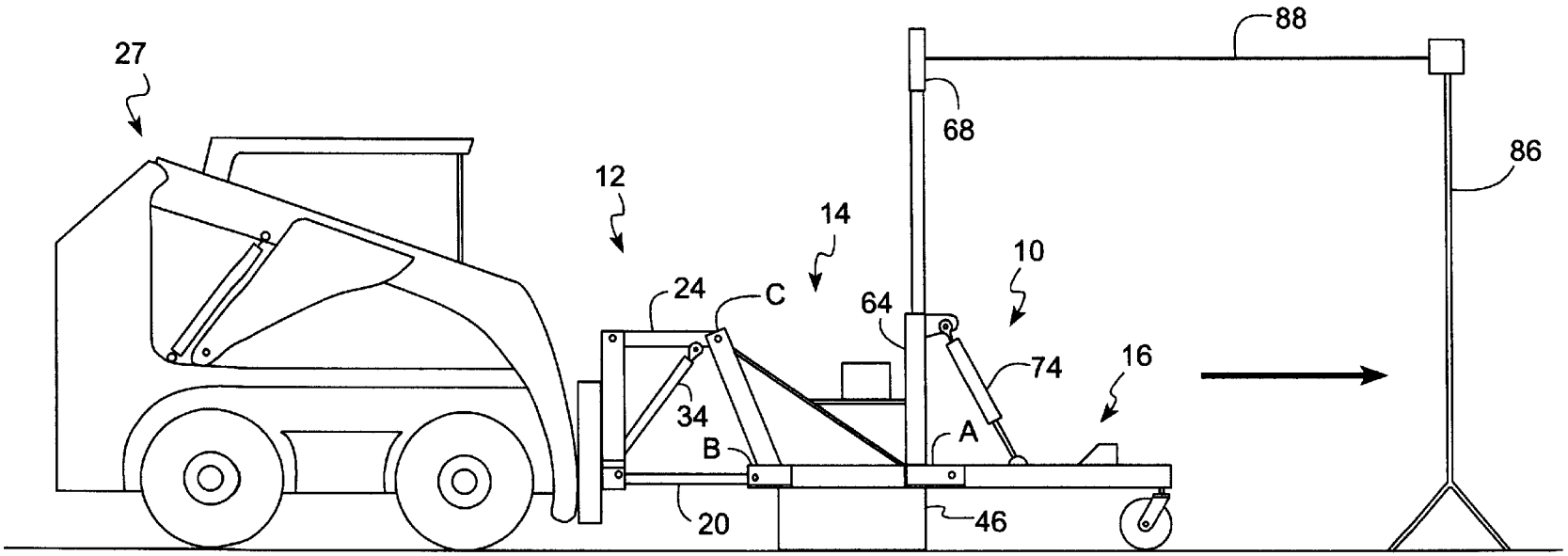
FIG. 4 is a side view of the surface leveling system with the box grader at ground level.

One additional purpose of the hitch 12 is to maintain the height at which surface leveling takes place, particularly when traveling in a forward direction as indicated by the arrow in FIG. 4. Preventing upward movement of the box grader frame is important because the location of the box grader frame 14 relative to ground determines the height at which surface leveling takes place. The box grader frame 14 tends to move upward during leveling of irregular surfaces, specifically, when high points in the irregular surface are being leveled.

To accomplish the purpose of maintaining the height of surface leveling, a damping system is added to the hitch 12. The damping system absorbs energy transmitted from the box grader frame 14 to the hitch 12 when the box grader frame 14 is being urged upward. This absorption of energy by the damping system helps limit the upward movement of the box grader frame 14.

In the presently preferred embodiment, two shock absorbers 34 are used as a damping system so as to prevent the box grader frame 14 from being urged upward. For example, shock absorber model number 73126, which is available from Gabriel Ride Control, Inc. of Nashville, Tenn., has been found to provide acceptable results. The shock absorbers 34 are preferably mounted so that one distal end is pivotably mounted to the rear support 18 and the other distal end is pivotably mounted to the upper link 24. Because the rear support 18 is fixed relative to the motive source 27, the shock absorber will resist pivot movement of the upper link 24 about pivot pin 32. The coefficient of damping of the shock absorber and geometry of the links is preferably such that movement of the upper link 24 will generally not occur under normal operating conditions when the box grader frame 14 is operated in a forward direction.

In addition to use of a damper such as shock absorbers 34, a bias spring (not shown) can be used to provide a spring biasing force between the stationary rear support 18 and the movable links 20, 22, 24. This biasing force can be used to actively urge the box grader frame 14 downward. Thus, this also prevents the box grader frame 14 from being urged upward.

The box grader frame comprises lateral members 36 and 38, a middle support 40, a cross brace 42, and grader brackets 44. The purpose of the box grader frame 14 is to support the box grader 46. Also, the box grader frame 14 can move vertically relative to the grading surface so as to allow the box grader 46 to grade earth at different heights. In the presently preferred embodiment, the box grader frame 14 is attached to the hitch 12 at three pivot points connecting the links 20, 22 and 24 to the grader frame 14. However, the invention is not limited in this regard. The two lower links 20 and 22 are pivotably connected to grader brackets 44 with pivot pins 32, and the upper link 24 is pivotably connected to a middle support 40 with a pivot pin 32.

The box grader 46 is adapted to grade earth in both forward and reverse directions. This adaptation includes locating a bi-directional earth grading tool 58 within the box grader 46. The earth grading tool 58 preferably is located approximately in the center of the box grader 46 so that soil can be accumulated on either side of the grading tool 58 between the end plates 48, 50. Also, the box grader 46 is advantageously formed as shown in FIG. 3 so that both the forward and rearward faces of the earth grading tool 58 can scrape and collect soil. Thus, when the chassis 10 is moving forward, the forward side of the earth grading tool 58 is grading earth and any excess earth is accumulated forward of the earth grading tool 58 in the cavity defined by the end plates 48, 50 and the grading tool. Conversely, when the chassis 10 is moving rearward, the rearward side of the earth grading tool 58 is grading earth and any excess earth is accumulated rearward of the earth grading tool 58.

Also disposed between the end plates 48 and 50 are two outer cross beams 54 and 56 and an inner cross beam 52. Both the inner and outer cross beams 52, 54 and 56 are connected to the end plates. Also, the inner cross beam 52 preferably attaches to and supports the earth grading tool 58. Another feature of the box grader is tool braces 60 and 62 which preferably extend the lateral length of the earth grading tool 58 and disposed adjacent thereto. The tool braces 60 and 62 act to brace the earth grading tool 58.

Figure 5:
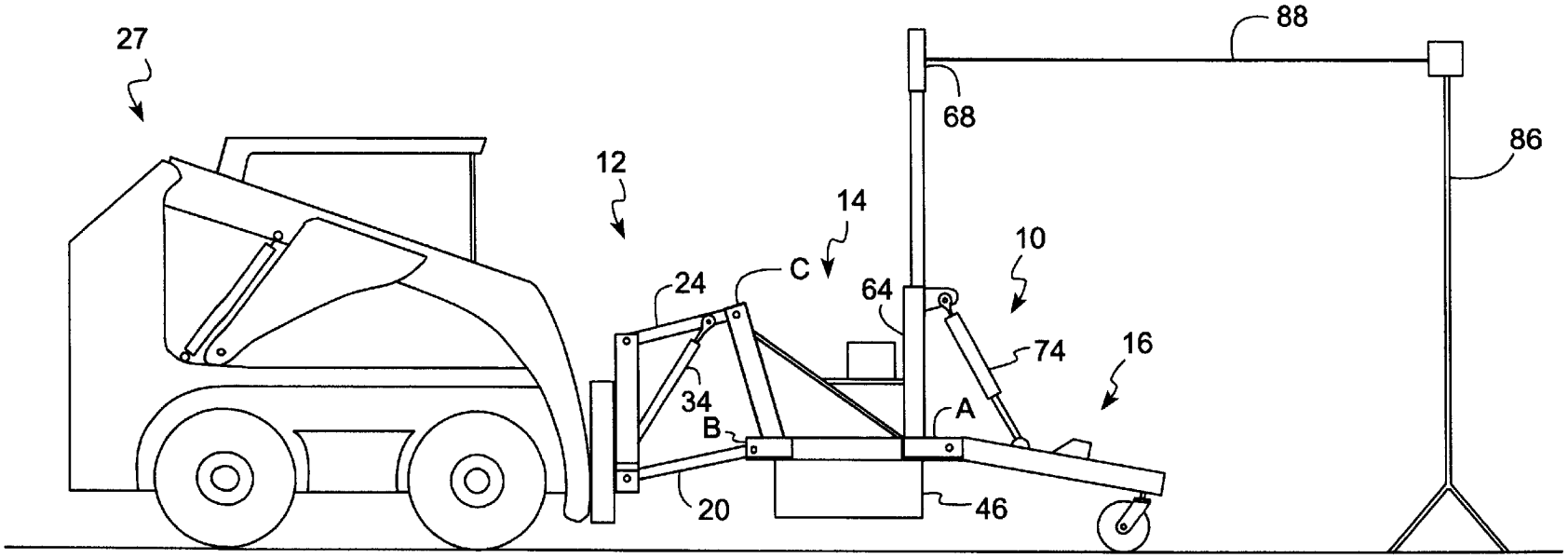
FIG. 5 is a side view of the surface leveling system with the box grader raised.

Optionally attached to the box grader 46 is a sensor support bar 66 and a laser sensor 68 to be used in combination with a laser beam generator 86 and laser beam 88 (shown in FIGS. 4 and 5). Using a laser/laser sensor combination with earth grading systems to change the height of grading is well known in the art of earth moving. Although FIG. 1 shows the presence of a laser sensor 68 as part of a laser/laser sensor combination, the invention is not limited to this feature for controlling the height of grading. Other means or methods for controlling the height of grading are well known in the art of earth moving and can be used with the invention.

Included on the chassis is a powered means to selectively urge the box grader frame 14 and therefore the box grader 46 upward or downward. Any means of urging the box grader frame 14 is acceptable. Examples include pneumatic pistons, gears powered by a motor, or a system of pulleys. In the presently preferred embodiment, a hydraulic piston 74 is used to urge the box grader frame 14 either upward or downward. The hydraulic piston 74 is preferably attached to a torque bar 64 which extends upward from box grader frame 14. Extension of the hydraulic piston 74 acts on the torque bar 64 so as to urge the box grader frame 14 upward. This action will be discussed in more detail with the discussion of FIGS. 4 and 5.

The forward frame 16 acts to support the box grader frame 14 on the side opposite the hitch 12. The forward frame 16 also provides a base against which the box grader frame 14 can be urged upward. In the presently preferred embodiment, the forward frame 16 comprises forward lateral bars 76 and 78, a forward cross bar 80 extending between the forward lateral bars 76 and 78, and caster wheels 82 and 84. The hydraulic piston 74 is preferably pivotably attached an opposing end to the forward cross bar 80.

The caster wheels 82 and 84 are preferably attached to forward frame 16 at the distal ends of the forward lateral bars 76 and 78. The caster wheels can pivot 360° around a vertical axis so that the chassis 10 can be rotated, pushed, or pulled by the motion source 27 in any direction. However, the invention is not limited to caster wheels 82 and 84. Any feature that both supports the chassis 10 and allows the chassis 10 to move easily in any direction can be used.

Although connected to the forward frame 16, the box grader frame 14 can move vertically relative to the grading surface because the forward lateral bars 76 and 78 of the forward frame 16 are pivotably connected to grader brackets 44 on the box grader frame 14 using pivot pins 32.

A control box 70 contains appropriate solenoid operated hydraulic values (not shown) which are known in the art and are actuated in response to signals received by to the laser sensor 68 or other level controlling means to direct hydraulic fluid to one or the other end of the hydraulic piston 74 using hydraulic hoses (not shown). Power for operation of the solenoid operated hydraulic values and hydraulic fluid is obtained either by connection to appropriate circuits on the motion source 27 or by a separate power source on the chassis 10.

The control box 70 may be disposed anywhere along the chassis 10 provided that it does not interfere with the workings of the chassis 10. In the presently preferred embodiment, the control box 70 is attached to a control platform 72 that extends from the torque bar 64 to the cross brace 42.

FIGS. 4 and 5 illustrate how extending or retracting the hydraulic piston 74 acts to lift or lower the box grader frame 14 and thus the box grader 46. FIG. 4 shows the box grader 46 at ground level, and FIG. 5 shows the box grader 46 raised.

The action of raising the box grader 46 requires the hydraulic piston 74 to be extended. Extending the hydraulic piston 74 causes the hydraulic piston 74 to push against both the torque bar 64 and the forward frame 16. The torque bar 64 is pushed upward, along with the box grader frame 14 and box grader 46, because the ground prevents the forward frame 16 from being pushed downward. The box grader frame 14 can move vertically relative to the forward frame 16 because the box grader frame 14 can pivot about the forward frame 16 at pivot point A. Also, the box grader frame 14 can move vertically relative to the hitch 12 because the box grader frame 14 can pivot about the hitch 12 at pivot points B and C.

To lower the box grader 46, the opposite action must occur such that the hydraulic piston 74 pulls against both the torque bar 64 and forward frame 16. The torque bar 64 is pulled down, along with the box grader frame 14 and box grader 46, because the force of gravity keeps the forward frame from being pulled upward. As the hydraulic piston 74 continues to retract, the box grader 46 will continue to lower until the box grader 46 contacts ground. After the box grader 46 reaches this point any additional retraction of the hydraulic piston 74 will cause the forward frame 14 to be raised upwards. The hydraulic piston 74 pulls the forward frame 14 upward because the ground now prevents the box grader 46 from being pulled downward any further.

What is claimed is:

1. A surface leveling system for grading earth and urged by a motion source, comprising:

a chassis comprising a rear support configured for attachment to said motion source, a forward frame attached to a wheel, a grader frame disposed between said rear support and said forward frame, said grader frame pivotably connected to said forward frame, a middle support extending from said grader frame and fixedly connected to said grader frame, a torque member extending above said grader frame and fixedly attached to said grader frame, and at least one upper link and one lower link substantially parallel to one another and each said links separately pivotably attached to both said rear support and to said middle support;

a dampening assembly having upper and lower distal ends and disposed between said rear and middle supports, said upper distal end pivotably connected to said upper link adjacent said middle support, and said lower distal end pivotably connected to said rear support, said dampening assembly damping upwards and downwards movement of said grader frame;

a box grader supported by said grader frame, said box grader including:

a bi-directional earth grading tool, said bi-directional earth grading tool having a first soil grading surface facing in a first grading direction for grading in said first direction and a second soil grading surface facing in a second grading direction for grading in said second direction, said first grading direction opposite said second grading direction, and a pair of end plates, said bi-directional earth grading tool centrally and perpendicularly mounted to each said end plates, said end plates and said bi-directional tool defining a cavity on each side of said bi-directional earth grading tool, each of said cavities configured for collecting soil during grading;

a piston pivotably connected to said forward frame and to said torque member whereby motion of said piston adjusts a distance of said grader frame and said earth grading tool relative to ground; and, a control unit for controlling the motion of said piston, said control unit attached to said chassis.

2. A surface leveling system according to claim 1, wherein said opposing soil grading surfaces form a single elongated blade member.

3. A surface leveling system according to claim 2, wherein each of said surfaces has a grading edge at its lowest point; and, said surfaces have a transverse cross section such that they are spaced at said grading edges, and taper together upwards.

4. A bi-directional surface leveling system for grading earth and urged by a motion source, comprising:

a chassis configured for attached to the motion source; and, a box grader supported by said chassis, said box grader including:

a bi-directional earth grading tool configured for grading soil in two opposing directions without adjustment, said bi-directional earth grading tool having a first soil grading surface facing in a first grading direction for grading in said first direction and a second soil grading surface facing in a second grading direction for grading in said second direction, said first grading direction opposite said second grading direction, and a pair of end plates, said bi-directional earth grading tool centrally and perpendicularly mounted to each said end plates, said end plates and said bi-directional earth grading tool defining a cavity on each of side of said bi-directional earth grading tool, each of said cavities configured for collecting soil during grading.

5. A bi-directional surface leveling system according to claim 4, wherein said chassis comprises:

a hitch, a grader frame pivotably connected to said hitch and supporting said box grader, and a forward frame pivotably attached to said grader frame and having at least one wheel for supporting said forward frame; and, said leveling system further comprising a dampening assembly attached to said hitch, said assembly damping upwards and downwards movement of said grader frame;

a powered means connected to said forward frame and to said grader frame for urging said grader frame upward; and, a control unit connected to said powered means for selectively controlling movement of said grader frame relative to a surface to be graded.

* * * * *